US005440498A

United States Patent [19]

Timm

[11] Patent Number: 5,440,498

[45] Date of Patent: Aug. 8, 1995

[54] METHOD FOR EVALUATING SECURITY OF PROTECTED FACILITIES

[76] Inventor: Ronald E. Timm, 57 Stone Creek Dr., Lemont, Ill. 60439

[21] Appl. No.: 58,491

[22] Filed: May 6, 1993

[51] Int. Cl.[6] ..... G06G 7/48

[52] U.S. Cl. ..... 364/516; 340/541

[58] Field of Search ..... 364/552, 554, 550, 516; 340/541, 542, 545, 568

*Primary Examiner*—Edward R. Cosimano
*Assistant Examiner*—Kamini Shah
*Attorney, Agent, or Firm*—Laff, Whitesel, Conte & Saret, Ltd.

[57] ABSTRACT

A method for analyzing and optimizing security systems is disclosed. A diagram is prepared which organizes and interrelates elements of the security system. The elements of the security system are tabulated in the diagram. Probabilities of detecting intrusion and neutralizing it are calculated and arranged in the diagram along an event tree. The effectiveness of protection against intrusion is readily determinable and quantifiable for any intrusion scenario by the arrangement of the security elements and the probabilities of detection.

15 Claims, 12 Drawing Sheets

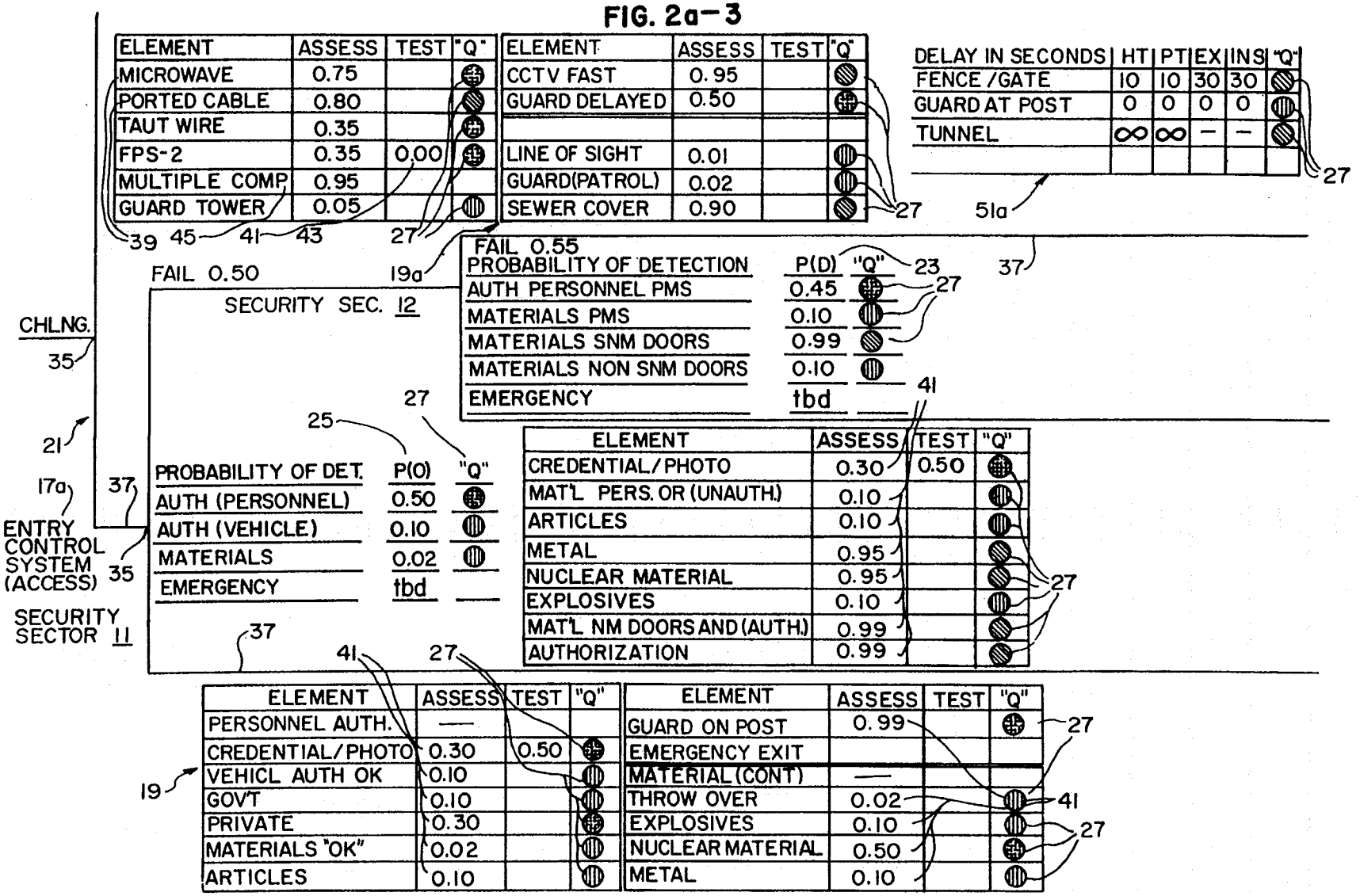
FIG. 2a-3
DELAY IN SECONDS
HT PT EX INS "Q"
FENCE/GATE 10 10 30 30
GUARD AT POST 0 0 0 0
TUNNEL ∞ ∞ – –
ELEMENT ASSESS TEST "Q"
MICROWAVE 0.75
PORTED CABLE 0.80
TAUT WIRE 0.35
FPS-2 0.35 0.00
MULTIPLE COMP 0.95
GUARD TOWER 0.05
CCTV FAST 0.95
GUARD DELAYED 0.50
LINE OF SIGHT 0.01
GUARD(PATROL) 0.02
SEWER COVER 0.90
FAIL 0.55
PROBABILITY OF DETECTION
AUTH PERSONNEL PMS 0.45
MATERIALS PMS 0.10
MATERIALS SNM DOORS 0.99
MATERIALS NON SNM DOORS 0.10
EMERGENCY tbd
P(D) "Q"
FAIL 0.50
SECURITY SEC. 12
PROBABILITY OF DET. P(I) "Q"
AUTH (PERSONNEL) 0.50
AUTH (VEHICLE) 0.10
MATERIALS 0.02
EMERGENCY tbd
ELEMENT ASSESS TEST "Q"
CREDENTIAL/PHOTO 0.30 0.50
MAT'L PERS. OR (UNAUTH.) 0.10
ARTICLES 0.10
METAL 0.95
NUCLEAR MATERIAL 0.95
EXPLOSIVES 0.10
MAT'L NM DOORS AND (AUTH.) 0.99
AUTHORIZATION 0.99
ELEMENT ASSESS TEST "Q"
PERSONNEL AUTH. —
CREDENTIAL/PHOTO 0.30 0.50
VEHICL AUTH OK 0.10
GOV'T 0.10
PRIVATE 0.30
MATERIALS "OK" 0.02
ARTICLES 0.10
ELEMENT ASSESS TEST "Q"
GUARD ON POST 0.99
EMERGENCY EXIT
MATERIAL (CONT)
THROW OVER 0.02
EXPLOSIVES 0.10
NUCLEAR MATERIAL 0.50
METAL 0.10
CHLNG.
ENTRY CONTROL SYSTEM (ACCESS)
SECURITY SECTOR 11
21
17a
19
35
37
39
41
43
45
19a
23
25
27
51a

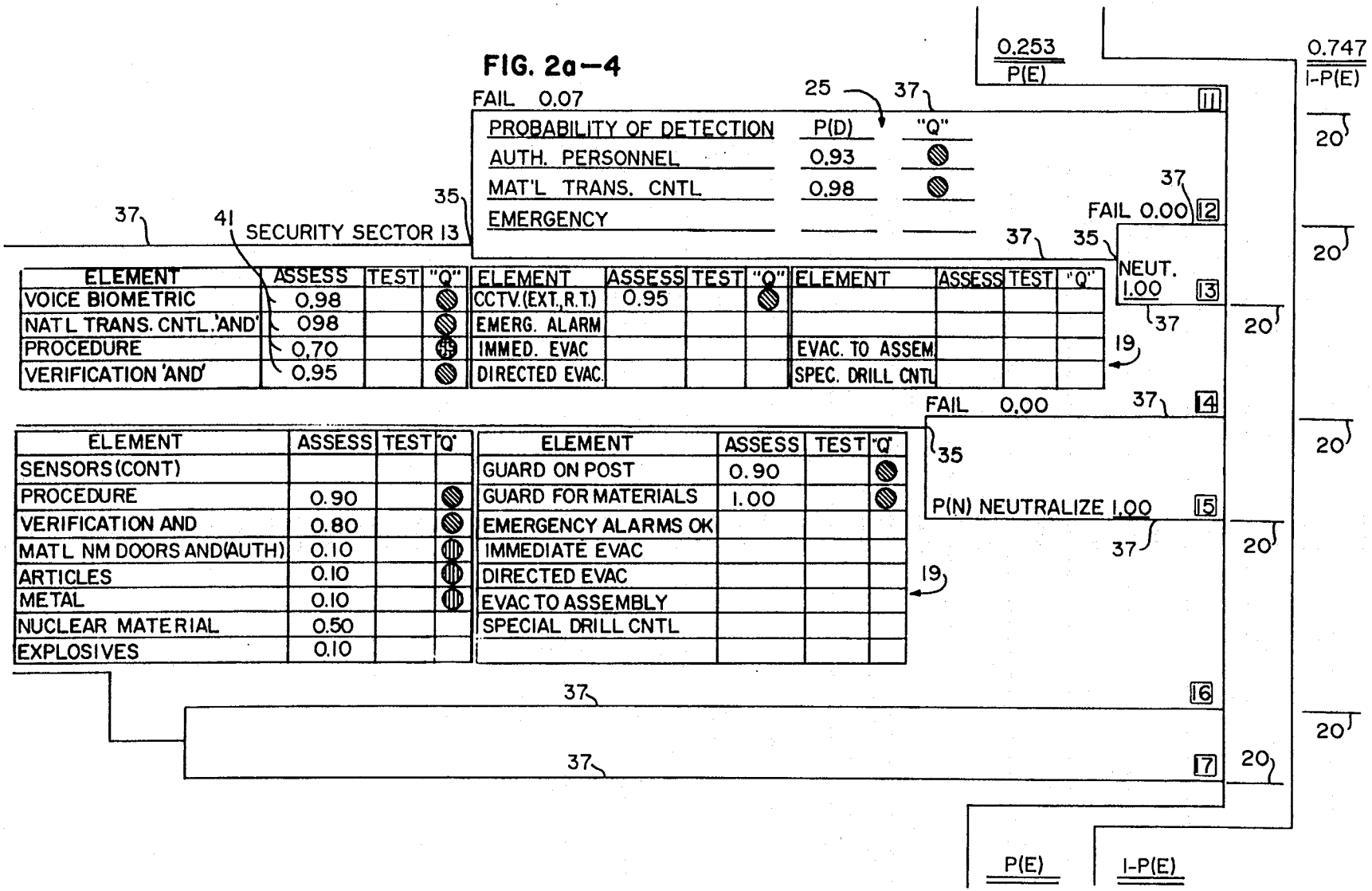
FIG. 2a—4
FAIL 0.07
PROBABILITY OF DETECTION
AUTH. PERSONNEL
MAT'L TRANS. CNTL
EMERGENCY
P(D)
0.93
0.98
"Q"
SECURITY SECTOR 13
ELEMENT
ASSESS
TEST
"Q"
VOICE BIOMETRIC 0.98
NAT'L TRANS. CNTL. 'AND' 0.98
PROCEDURE 0.70
VERIFICATION 'AND' 0.95
CCTV.(EXT.,R.T.) 0.95
EMERG. ALARM
IMMED. EVAC
DIRECTED EVAC.
EVAC. TO ASSEM.
SPEC. DRILL CNTL
FAIL 0.00
NEUT. 1.00
FAIL 0.00
P(N) NEUTRALIZE 1.00
SENSORS (CONT)
PROCEDURE 0.90
VERIFICATION AND 0.80
MAT'L NM DOORS AND (AUTH) 0.10
ARTICLES 0.10
METAL 0.10
NUCLEAR MATERIAL 0.50
EXPLOSIVES 0.10
GUARD ON POST 0.90
GUARD FOR MATERIALS 1.00
EMERGENCY ALARMS OK
IMMEDIATE EVAC
DIRECTED EVAC
EVAC TO ASSEMBLY
SPECIAL DRILL CNTL
0.253 / P(E)
0.747 / 1-P(E)
P(E)
1-P(E)
11
12
13
14
15
16
17
20
19
25
35
37
41

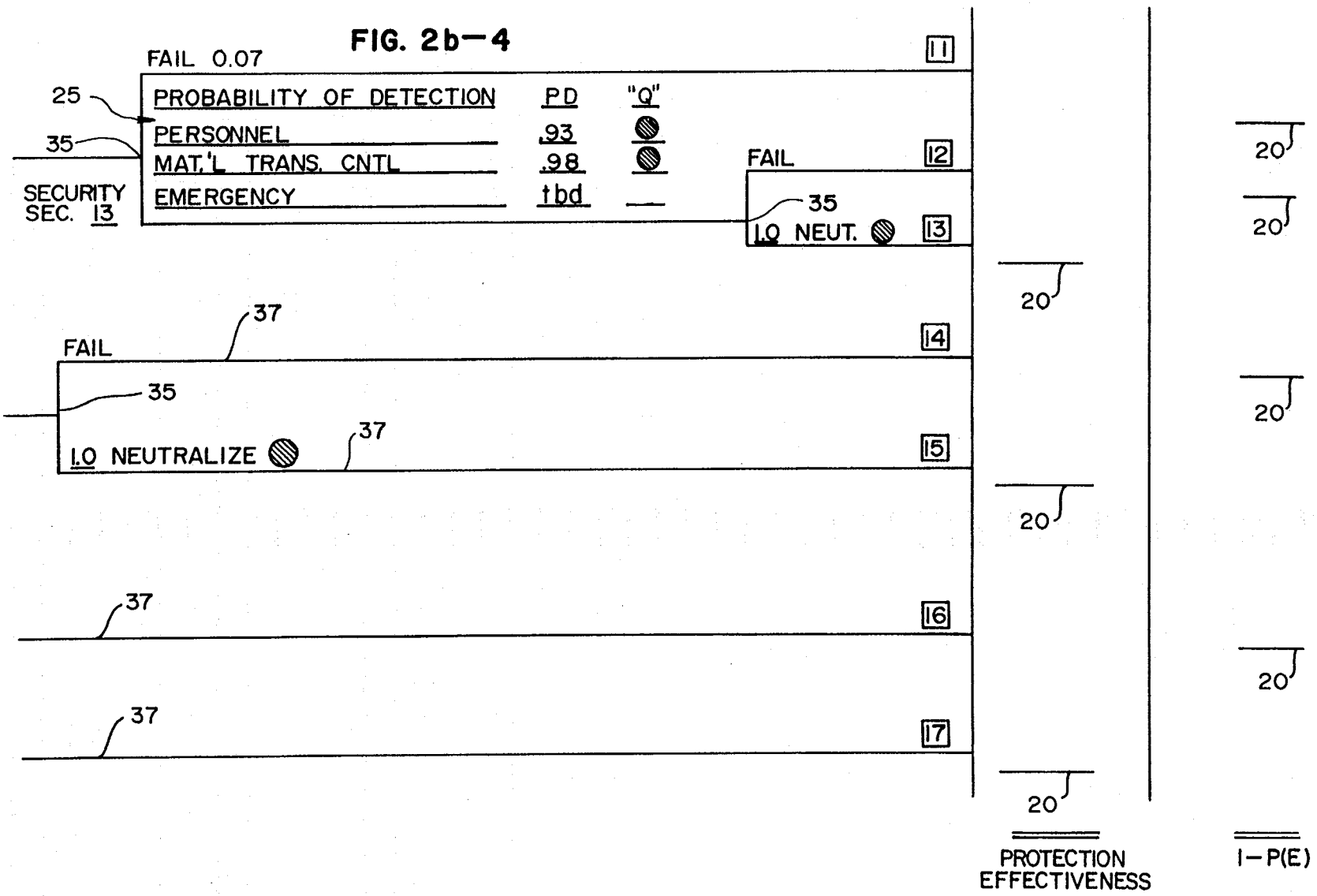
FIG. 2b—4
FAIL 0.07
PROBABILITY OF DETECTION
PD
"Q"
PERSONNEL
.93
MAT.'L TRANS. CNTL
.98
EMERGENCY
tbd
SECURITY SEC. 13
25
35
11
12
13
14
15
16
17
FAIL
I.O NEUT.
I.O NEUTRALIZE
37
20
PROTECTION EFFECTIVENESS
I−P(E)

METHOD FOR EVALUATING SECURITY OF PROTECTED FACILITIES

FIELD OF THE INVENTION

This invention relates to security systems for protected facilities, and more particularly to a method for evaluating and enhancing the security elements in a security system for a protected facility.

BACKGROUND OF THE INVENTION

A security system for protecting a facility, such as a building, manufacturing site or storage depot, can consist of one or more layers of protection around assets which would otherwise be subject to acts of theft or vandalism. The elements of a security system typically will function to detect unauthorized action to the protected facility, personnel or property, delay such actions, and respond to such threats. Security elements which detect intruders include a variety of electronic sensors, as well as door and window switches. Security elements which delay intrusion include familiar hardware such as reinforced doors, walls and locks. Finally, security elements for response often involve the personnel such as guards or local authorities alerted to the intrusion.

Currently, the design and construction of security systems for protected facilities typically involves ad hoc selections of such security elements. In the typical secured environment today, such elements are added to a system in piecemeal fashion, oftentimes in response to an act of theft or vandalism which has already occurred. Furthermore, the placement of multiple security elements about a protected area is generally accomplished without regard to the resulting overall effectiveness of protection. The resulting security systems thus require excessive investment in either hardware or personnel in some areas, while leaving other areas relatively vulnerable to challenge by unauthorized outside or inside actions.

There is no adequate structured method today for optimizing the security of a protected facility on a system-wide basis. The state of the art of security systems analysis does not offer a rigorous method for evaluating the relative effectiveness of the security of different security sectors of a protected facility or different security layers of that facility. Absent such methods, security elements added to an existing security system often do not increase overall protection because there is vulnerability in another security element which was not detected by the traditional, ad hoc approach. Financial resources thus are squandered on ineffectual security elements.

Especially at the initial design and construction stages, if a system-wide method for analyzing and optimizing protection were employed, a security system with more cost-effective deployment of security elements would result.

SUMMARY OF THE INVENTION

It is therefore an object of this invention to overcome the shortcomings and failings of prior art methods of security system design, construction, and analysis, by providing a novel method of evaluating and optimizing security systems by identifying the elements of the security system, organizing them according to their function and location in a protected facility, and quantifying the relative capabilities of the elements to protect the facility.

Another object of this invention is to provide a method to evaluate the probabilities of detection by the security elements of a given security sector or security layer of a security system and thereby evaluate the effectiveness of protection of security for that sector or layer.

It is a further object of this invention to provide a method for identifying potential enhancements to a security system.

It is a still further object of this invention to provide a method of quantifying the improvement which can be achieved by proposed enhancements to a security system.

This invention offers advantages in all phases of design, construction and evaluation of security systems. One such advantage is the ability to compare the effectiveness of any security element or group of elements of the security system with another element or group of elements. Not only does this method reveal the less effective security elements of a system, but also it can be employed to evaluate whether proposed additions to a security system would enhance protection of the facility and, if so, by how much. This method can also be further employed to great advantage in the initial planning and design of a security system, and in selecting cost effective security elements to optimize protection against intrusion.

DETAILED DESCRIPTION OF THE INVENTION

Figure 1A:
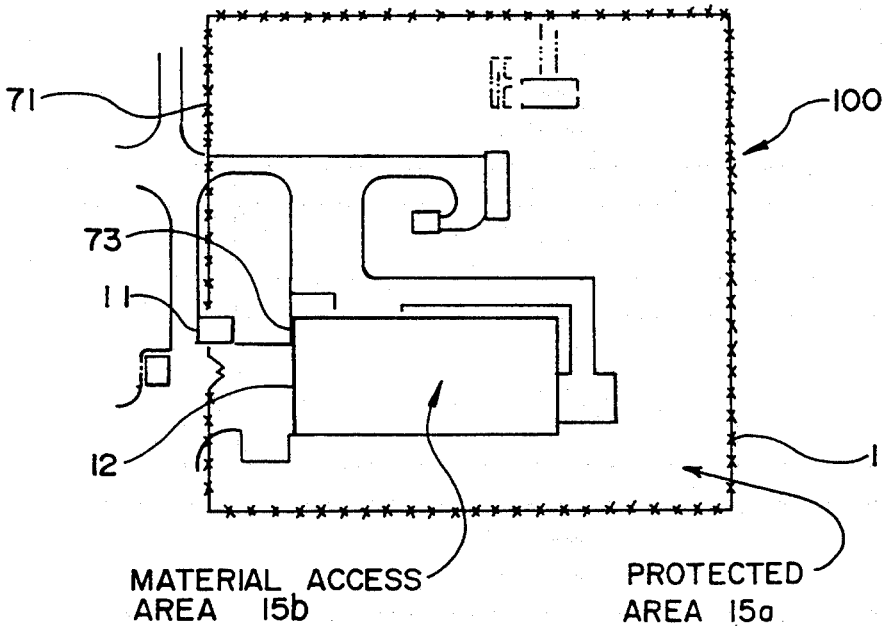
FIG. 1*a* is an architectural plan view of a secured facility designed in accordance with the method of this invention.
Figure 1B:
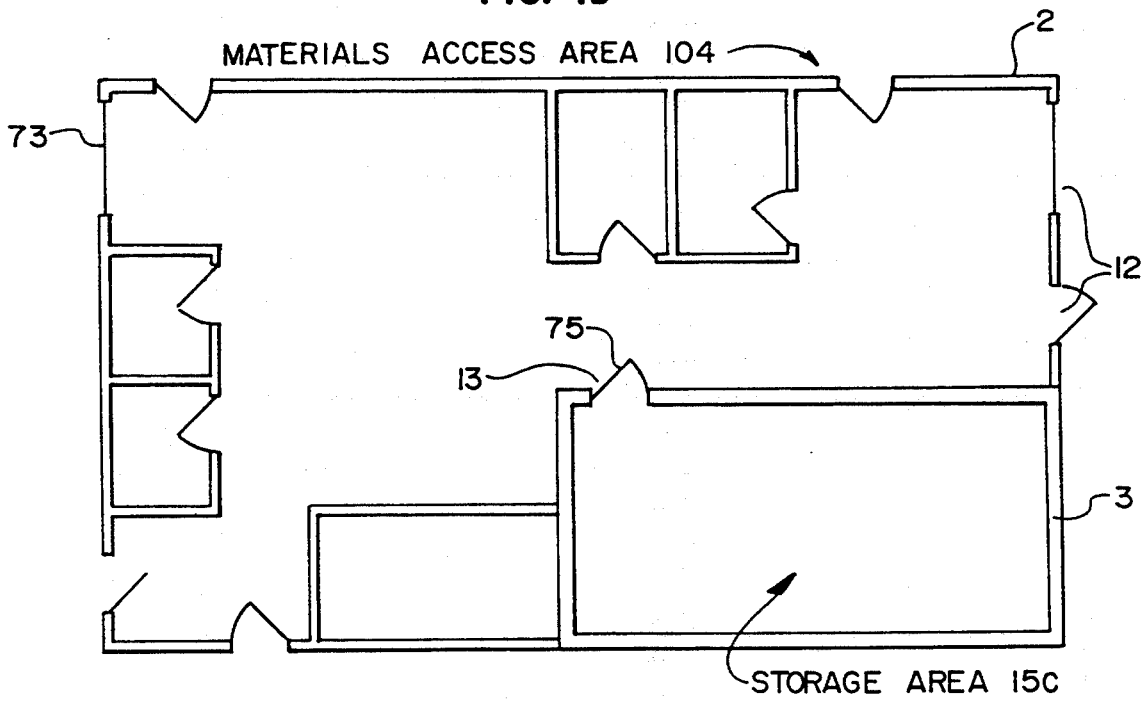
FIG. 1*b* is an enlarged architectural plan view of the materials access area of the secured facility of FIG. 1*a*.
Figure 2B:
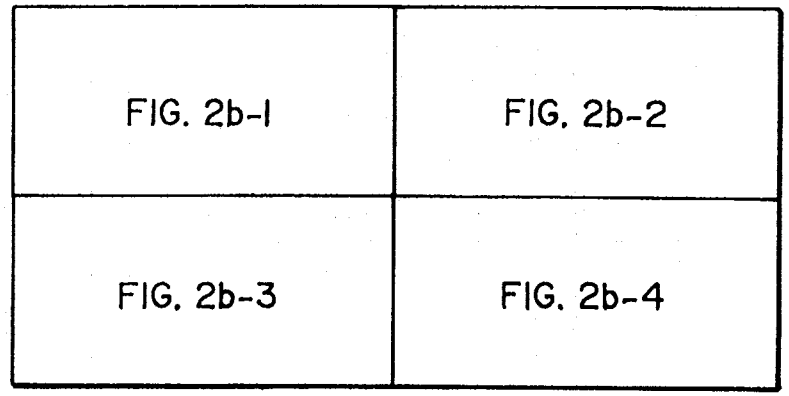
FIG. 2*b* (comprising FIG. 2*b*-1 through 2*b*-4) is an alternate chart to that of FIG. 2*a* used in carrying out the method of this invention.
Figure 2A:
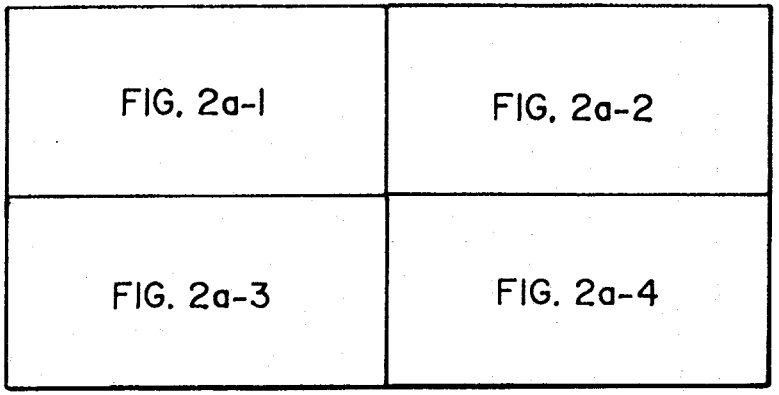
FIG. 2*a* (comprising FIG. 2*a*-1 through FIG. 2*a*-4) is a chart used in carrying out the method of this invention.

Referring now to the drawings, and more particularly to FIGS. 1*a* and 1*b* and (FIG. 2*a*-1 through 2*a*-4 hereinafter refered to as) FIG. 2*a* thereof, there is depicted a protected facility 100 (FIGS. 1*a* and 1*b*) which has benefited from the method of this invention and which will serve as a working example for the method thereof. The chart of FIG. 2*a* has been prepared in accordance with this invention to include three security layers 15; subsystems 17; security sectors 1, 2, 3, 11, 12, and 13; tables 19 associated with the security sectors; an event tree 21; and a table of outcome probabilities 29. The security layers 15, the subsystems 17, and the sectors 1, 2, 3, 11, 12, and 13 of the chart of FIG. 2*a* correspond to physical zones and security elements of the protected facility 100, and have been given like reference numbers in FIGS. 1*a* and 1*b*.

The various security elements of the protected facility 100 and the corresponding security ratings for the security elements are tabulated in the tables 19 for each of the security sectors. Numerical values for the probabilities of detection P(D) are calculated for each of the security sectors as a function of the security elements of the sector and the corresponding security ratings of the security elements. The probabilities of detection P(D) are tabulated in subtables 25 of tables 19. Color codes 27 comprising red, yellow, or green dots are affixed in the column labeled "Q" and the subtable 25. Outcome probabilities 20 are calculated as a function of the probabilities of detection P(D) and a neutralization probability P(N). The outcome probability values 20 are tabulated in the outcome probabilities table 29 located on the right-hand side of the chart of FIG. 2*a*. A protection effectiveness value P(E) is calculated from the outcome probabilities 20 and tabulated in the outcome probabilities table 29.

The three security layers 15 are arranged horizontally across the chart of FIG. 2*a*. The security layers 15 are referred to respectively as the "Protected Area 15*a*," the "Material Access Area 15*b*," and the "Storage Area 15*c*," and correspond to physical areas of the protected facility 100 shown in FIGS. 1*a* and 1*b*. Note that the Storage Area 15*c* is within the Materials Access Area 15*b*, which in turn is within the Protected Area 15*a*. The security subsystems 17, vertically arranged on the chart of FIG. 2*a*, are referred to particularly as the "Entry Control System 17*a*" which includes all gates, doors and other traditional controlled entrances to the protected facility 100; and the "Intrusion Detection System 17*b*" which includes security elements other than gates and doors, such as walls, fences and motion sensors. Security elements of the Intrusion Detection System 17*b* primarily respond to intrusions by outsiders; elements of the Entry Control System 17*a* protect not only against outside intrusions but also against unauthorized activities by insiders.

The physical locations within the protected facility 100 which are designated as security sectors 1, 2, 3, 11, 12, and 13 (FIGS. 1*a* and 1*b*) are also represented on the chart of FIG. 2*a* and are defined by the intersections of the horizontally arranged security layers 15 and the vertically arranged security subsystems 17.

An event tree 21 (FIG. 2*a*) begins at the Intrusion Detection System 17*b* and the Entry Control System 17*a* and is arranged in the chart of FIG. 2*a* with bifurcations 35 located at each of the security sectors. The event tree 21 is employed to organize and tabulate the calculated values of the outcome probabilities 20 (FIG. 2*a*). Branches 37 of the event tree extend to the right across the chart of FIG. 2*a* from each bifurcation 35 to form the outcome probabilities table 29.

After preparing the chart of FIG. 2*a* in the manner described above, the security elements of the protected installation 100 shown in FIGS. 1*a* and 1*b* are tabulated in the tables 19 according to the security sector and the security subsystem in which each of the security elements is located. This tabulation step as it relates to the security sector 1 will now be described.

As shown in FIG. 2*a*, the various commercially available security elements of the sector 1 are tabulated in the table 19*a*. Each security element is listed in one of the rows 39 of the table 19*a* in the columns labeled "Element." The security elements which have been tabulated for the sector 1 of the protected facility 100 in the table 19*a* include a microwave motion detector identified as "Microwave," a Ported Cable identified as "Ported," a "Taut Wire," an FPS-2 (a fence perimeter sensor), a secured sewer cover, a "Guard," a fast closed circuit television system identified as "CCTV, Fast," a surveillance tower identified as "Guard (Tower)," a patrolling guard labeled "Guard (Patrol)," and "Line-of-Sight" observations. Each commercially available security element listed for the sector 1 in table 19*a* has a security rating 41 which is certified by independent laboratories, and is generally a value between 0 and 1, with 1 representing 100 percent effectiveness. These ratings are listed in a column of the table 19*a* labeled "Assess" and in the row 39 of the security element to which the particular security rating 41 corresponds. If actual field testing of the security element at the protected installation has yielded a security rating, that value is listed in a column labeled "Test" and in the row 39 for the particular security element to which the value corresponds.

Having tabulated the security elements of the sector 1, the corresponding security ratings 41, and the corresponding test ratings (if applicable), now the probabilities of detection P(D) are calculated and tabulated for the sector 1 in the subtable 25*a*. The probabilities of detection P(D) are calculated as functions of the security ratings 41 of the security elements. The probability of detection P(D) of intrusion from air, from the ground, and from tunnelling are listed in the corresponding row of the subtable 25*a*.

To calculate a value for the probability of detection P(D) for a given type of intrusion (air, ground or tunnel), the particular security elements which respond to that type of intrusion are selected from the table 19*a*, and the security ratings for the selected security elements are combined using known algorithms of probability, as described below. The resulting probability of detection P(D) value is between 0 and 1, with 1 representing 100 percent probability of detection.

For example, the probability of detection P(D) of an air intrusion is the logical sum of the individual chances of detection by the tower, the patrol, and line-of-sight observations. Equating the chance of detection by a security element with its corresponding security rating 41, the standard algorithm for finding the probability of detection P(D) of an air intrusion by multiple security elements can be expressed as follows:

$$P(D)=R_T+[(1-R_T)*R_P]+[(1-R_T)*(1-R_P)*R_O]$$

where $R_T$=security rating of the tower, $R_P$=security rating of the patrol, and $R_O$=security rating of the line-of-sight observer.

Using the security ratings 41 for the above-selected security elements tabulated in the table 19*a*, the probability of detection P(D) equals 0.07 when rounded to two decimal places, which value is tabulated in the appropriate row at location 86 of the subtable 25*a*.

The probability of detection P(D) for ground intrusion is calculated in a similar manner to that described above. The security elements of the table 19*a* which are challenged by a ground intrusion include the microwave sensor, the ported cable, the taut wire, and the FPS-2.

Since these elements act together to sense .intrusion, their security ratings are added to obtain the logical sum using the probability algorithm set forth above to obtain a rating for the combined probability of these sensors as follows:

$$R_M+[(1-R_M)*R_P]+[(1-R_M),(1-R_P)*R_T]+[(1-R_M)*(1-R_P)*(1-R_T)*R_F]$$

where $R_M$=security rating of the microwave sensor, $R_P$=security rating of the ported wire, $R_T$=security rating of the taut wire, and $R_F$=security rating of the FPS-2.

Using the security rating 41 tabulated for the above security elements in the table 19*a*, a multiple complementary sensor rating 43 is tabulated in a row 45 of the table 19*a*. The multiple complementary sensor rating 43 represents the capacity of security elements which are sensing devices to detect intrusion. The probability of detection P(D) depends not only on sensing devices, but also on security elements which correspond to security personnel, who must accurately assess the output of the sensing devices. For the sector 1, then, the probability of detection P(D) is a function of the multiple complementary sensor rating 43 just tabulated and the security ratings 41 of the specific security elements "Guard" and "CCTV, Fast," each of which involve observation by security personnel in assessing intrusions. Standard security analysis rules call for selecting from these two elements the one element more likely to be used in assessing an intrusion, in this case, the fast, closed-circuit television labeled "CCTV, Fast" with a security rating of 0.95. Algorithms of probability are now used to calculate the probability of detection P(D) of a ground intrusion. The multiple complementary sensor rating 43 is multiplied by the security rating of the CCTV of 0.95, yielding a product of 0.91 when rounded, which value is tabulated in the appropriate row of subtable 25*a* at location 78.

Probability algorithms and security analysis rules are similarly applied to calculate and tabulate a value for the probability of detection P(D) of a tunnel intrusion. Under security analysis rules, the only security element which protects from a tunneling intrusion in their sector 1 is that labeled "Sewer Cover," and having a security rating of 0.9. Of the security elements tabulated in the table 19*a* which involve assessments by security personnel, the security guard is more likely to detect a tunneling intrusion and has a security rating tabulated in the chart 19*a* of 0.5. As found in the previous calculation, the resulting probability of detection P(D) is the product of 0.5 and 0.9 and is therefore tabulated in the appropriate row of the subtable 25*a* as 0.45.

The tabulation of the probabilities of detection P(D) for the security sector 1 is thus complete in the subtable 25*a* shown in FIG. 2*a*. Now, the subtable 51*a* in the sector 1 labeled "Delay in Seconds" is filled in with values readily obtainable in publications in the security analysis field. These values represent the anticipated delay (in seconds) suffered by an intruder in overcoming passive security elements of the security sector 1 such as walls and fences. Each such security element is tabulated in a separate row of the subtable 51*a* identified under the column labeled "Delay in Seconds," with anticipated delay in using hand tools tabulated under the column "HT," power tools under "PT," explosives under "EX," and assistance by an insider under "INS."

The above-described method for evaluating the security sector 1 is employed in the same manner to evaluate the security sectors 2, 3, 11, 12, and 13 in the chart of FIG. 2*a* for the protected installation 100 shown in FIGS. 1*a* and 1*b*. The security elements are tabulated along with their corresponding security ratings 41 in the appropriate rows and columns of the table 19 for each of these other security sectors. The probabilities of detection P(D) are determined using the above-described rules of security analysis and algorithms of probability, and are tabulated in the relevant subtable 25 for each of the security sectors defined in the chart of FIG. 2*a*.

Outcome probabilities 20 (FIG. 2*a*) are tabulated in the outcome probabilities table 29. They represent in numerical terms the ability of the security sectors to protect against various types of intrusion. The outcome probabilities 20 are determined by employing the event tree 21 in conjunction with the probabilities of detection P(D) which have been listed in the tables 19 in previous steps, and neutralization probabilities P(N) which shall be determined in a manner described subsequently.

Different outcome probabilities 20 can be determined for different intrusion scenarios using the event tree 21 and the security sectors. For the working example of this embodiment, the intrusion scenario involves a challenge to a fence 71 (FIG. 1*a*) of the security layer 15*a* labeled "Protected Area" (FIG. 2*a*), followed by an attempt to penetrate the next security layer 15*b* labeled "Material Access Area" (FIG. 2*a*) through a garage door 73 (FIG. 1*b*), followed by an attempt to access the innermost security layer 15*c* labeled "Storage Area" (FIG. 2*a*) by breaching a reinforced door 75 (FIG. 1*b*). The security elements involved in detecting the challenge to the fence 71 in this intrusion scenario have been represented in the tables 19 of the security sector 1 (FIG. 2*a*). A branch 37*a* (FIG. 2*b*-1 through 2*b*-4, herein after refered to as) (FIG. 2*b*) of the event tree 21 guides the analysis to a bifurcation 35*a* associated with sector 1. A branch 37*b* extending from the bifurcation 35*a* runs adjacent to the subtable 25*a* in which the probabilities of detection P(D) for the sector 1 have been tabulated. The probability of detection P(D) for ground intrusion, labeled "Secure (Ground)," is selected for further discussion since the intruder is ground-based in this working example. The tabulated value of the probability of detection P(D) for ground intrusion equals 0.91, and is assigned to the branch 37*b*.

A branch 37*c* extending from the bifurcation 35*a* and labeled "Fail" is assigned a value representing the probability of not detecting the intrusion in the sector 1, which can be expressed as $1\text{-}P(D_1)$ where P(D1) equals the value of the probability of detection P(D) selected for this sector 1. The resulting value of $1-0.91=0.09$ and is tabulated at location 80 adjacent to the branch 37*c*.

The outcome probabilities 20 for the sector 1 are determined by multiplying the probability of detection P(D) for ground intrusion, having a value of 0.91 (see location 78) by the neutralization probability P(N), which will be determined now. From the values tabulated in subtable 51*a*, which, as described previously, represent the delay imposed upon an intruder by the security elements of the sector 1, values are selected corresponding to the intruder in this intrusion scenario. Since hand tools are involved, the delay table value of 10 seconds for the fence/gate is selected.

This value is then used in conjunction with fuzzy logic, i.e., the use of value ranges or value categories instead of discrete or specific values, to determine the likelihood that a security guard would intercept the intruder. Thus, the likelihood that a security guard would intercept the intruder is assigned a value range or category of LO, MED or HI (low, medium, or high) and is tabulated in location 52 labeled "SI Deployed," i.e., security inspector deployed. If a "LO" is tabulated at the location 52, then the neutralization probability P(N) is assigned the low value 0.2; if "MED" then the neutralization probability P(N) has a medium value of 0.5; if "HI," then the neutralization probability P(N) is a high value of 0.9. The value of P(N), in this case equalling 0.2, is entered at location 76 adjacent to the branch 37*d*.

The outcome probabilities 20*a* and 20*b* for the sector 1 are determined by multiplying the neutralization probability P(N), having a value of 0.2 (see location 76), by the probability of detection P(D) for ground intrusion, having a value of 0.91 (see location 78), which yields a value for the outcome probability 20*a* of 0.182. Since the outcome probability 20*a* represents the likelihood that an intruder will be successfully neutralized in sector 1, the branch 37*d* extending from the bifurcation 35*b* is followed across the chart of FIG. 2*a* in order to tabulate the value 0.182 at the intersection point of the branch 37*d* with the outcome probability table 29 under the column labeled "Neutralized Paths."

An outcome probability 20*b*, representing failure to neutralize, is calculated by known probability principles by subtracting the outcome probability 20*a* from the value of 1, yielding a value of 0.728. This value is tabulated by using the branch 37*e* labeled "Fail" of the bifurcation 35*b*, which extends across the chart of FIG. 2*a* and intersects the outcome probability table 29, at which point the value 0.728 is listed under the column labeled "Non-Neutralized Paths."

The outcome probability values 20 for the additional security sectors involved in this intrusion scenario are similarly calculated by using the rules of probability in combination with the event tree 21. Assuming the sector 1 fails to detect the intruder in the scenario described above, the branch 37*c* labeled "Fail" guides the analysis to the next security layer 15*b* and to the security sector 2 shown in the chart of FIG. 2*a* which includes the security elements involved in detecting an intruder's attempt to breach the garage door.

The outcome probabilities 20 for the sector 2 are found in a manner similar to that of sector 1 as described below. The appropriate value for the probability of detection P(D) is selected from the subtable 25*b* for the sector 2, which in this scenario is 0.80 (see location 82). The probability of failing to detect the intrusion in this sector 2 is tabulated at a location 84 of a branch 37*f*, which, using principles of probability, has a value of 0.20.

The calculation of outcome probabilities 20*c* and 20*d* for the sector 2 is not only a function of the probability of detection P(D) and the neutralization probability P(N), but also a function of the probability of failing to detect the intrusion in the sector 1, which value was tabulated previously as 0.09 at the location 80. An outcome probability 20*c* for the sector 2, representing successful neutralization by the sector 2, is tabulated in the outcome probability table 29 after its value is calculated by the following probability algorithm:

outcome probability 20*c*$=(1-P(D_1))$ , $P(D_2)$, $P(N_2)$ where $P(D_N)$=selected value of the probability of detection P(N) of the sector N, and P $(N_N)$ is the neutralization probability P(N) of the sector N.

Similarly, an outcome probability 20*d* is tabulated in the outcome probability table 29 after its value is calculated using the same notation as above by the following probability algorithm:

outcome probability 20*d*$=(1-P(D_1))$ * $P(D_2)$ * $(1-P(N_2))$.

The remaining outcome probabilities are calculated using the same principles applied to the probabilities of detection P(D) and the neutralization probabilities P(N) for the security sector 3, which is the next sector encountered by the intruder in the working example. The algorithms are as follows:

an outcome probability 20*e*$=(1-P(D_1))$ * $(1-P(D_2))$ * $P(D_3)$ * $P(N_3)$ an outcome probability 20*f*$=(1-P(D_1))$ * $(1-P(D_2))$, $P(D_3)$ * $(1-P(N_3))$ an outcome probability 20*g*$=(1-P(D_1))$ * $(1-P(D_2))$ * $(1-P(D_3))$ The arrangement of the outcome probabilities 20 in the outcome probability table 29 allows for the outcome probabilities 20*a*, 20*c*, and 20*e* be readily compared to one another to evaluate the relative effectiveness of security. Since different intrusion scenarios generate different outcome probability values, different protection effectiveness values P(E) can also be generated for the different intrusion scenarios, allowing for evaluation for the relative strengths against different types of intruders of the security sectors 1, 2, 3, 11, 12, and 13; the security layers 15, and the security subsystems 17. The security ratings 41 certified by independent laboratories can be used to generate a protection effectiveness value P(E), and the actual tested ratings can be used to generate a second protection effectiveness value P(E).

Color codes 63 are affixed in accordance with the method of this invention in the column labeled "Q" of the table 19 for each of the tabulated security elements in order to indicate the quality level of each of the security elements. The color code 63 is either red, yellow, or green, depending on whether the quality level of the corresponding security element is assessed under security analysis rules to be poor, fair, or good, respectively. Color codes 63 can similarly be affixed adjacent to other values on the chart of FIG. 2*a*, such as the probabilities of detection P(D) or the outcome probabilities 20, thereby creating an effective method for assessing security weaknesses and strengths at a glance.

The present method is not limited to evaluation of existing security systems, but also can be employed to design and optimize new security systems at any phase of planning or construction. The elements of a proposed security system design can be tabulated in the appropriate security sectors of the chart of FIG. 2*a* along with their corresponding security ratings 41; then the probabilities of detection P(D) can be determined as described previously in accordance with the present method; and the outcome probabilities 20 can be tabulated for selected intrusion scenarios.

The method then determines the protection effectiveness value P(E) for the proposed design. Any of the above values. calculated and tabulated for the proposed design can be calculated and tabulated for any number of alternative design proposals, and the alternative sets of values can be compared to select those which optimize the security system. Fuzzy logic can be used when comparing such alternative sets of values to determine whether they are "unacceptable" or "good enough". By quantifying the probabilities of detection P(D), the outcome probabilities 20, and the protection effectiveness values P(E); and by organizing these values along the event tree 21, the method can be used by designers, security systems analysts, or similar personnel at any level of skill in the art.

The novel method of evaluating security systems at protected facilities such as that of the protected facility 100 shown in FIGS. 1*a* and 1*b* can be employed using diagrams alternative to the chart of FIG. 2*a*. Specifically, the chart of FIG. 2*b* depicts the protected facility 100 after evaluation under the present method. Unlike the chart of FIG. 2*a*, here only the subtables 25 are delineated for each of the corresponding security sectors.

Figure 2C:
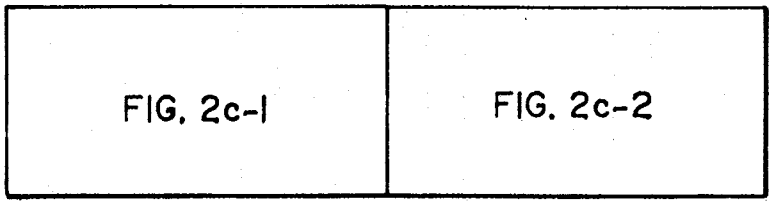
FIG. 2*c* (comprising FIG. 2*c*-1 through FIG. 2*c*-2) is a second alternate chart to that of FIGS. 2*a* and 2*b* used in carrying out the method of this invention.
Figures 1, 2A:
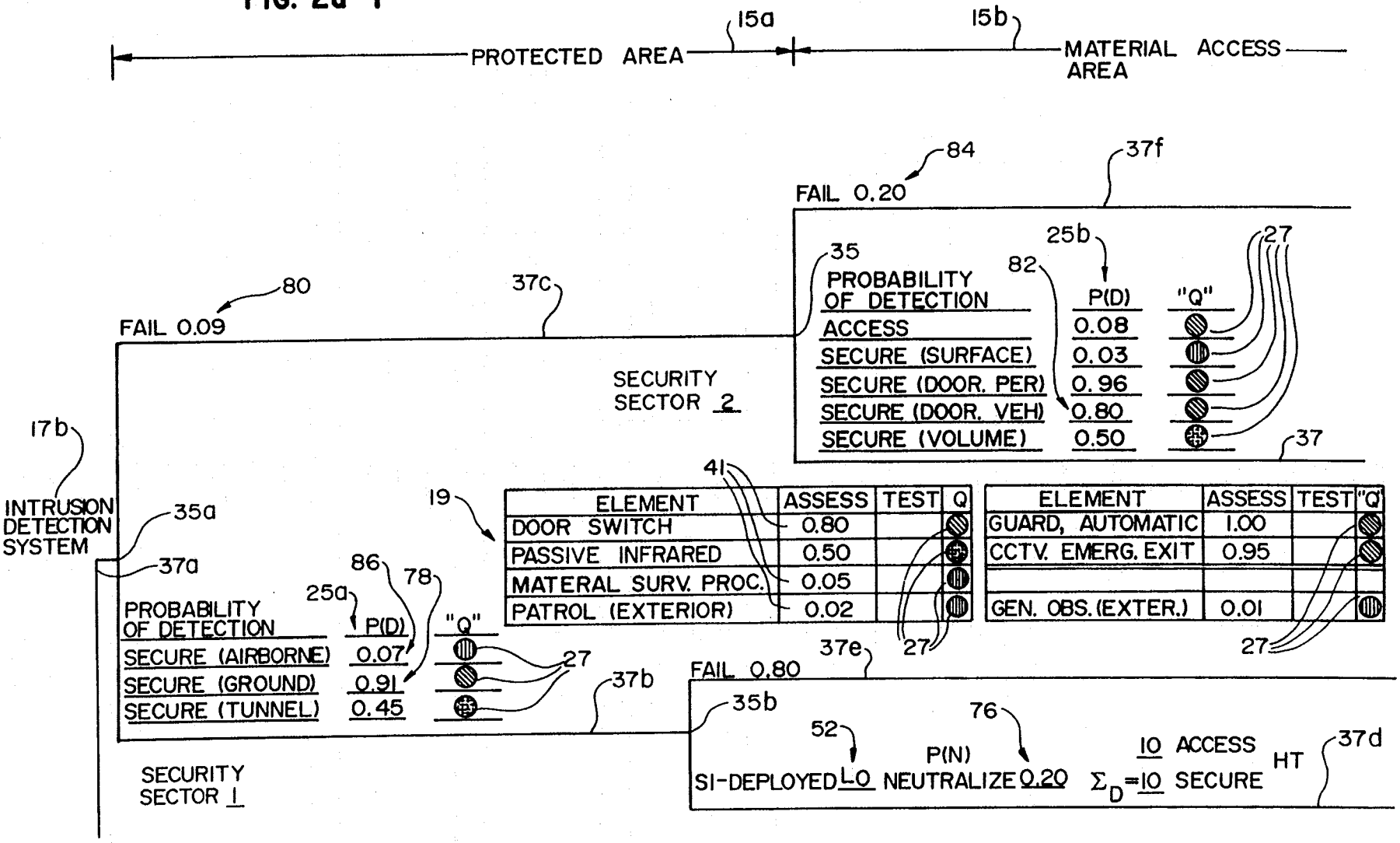
Figures 2, 2A:
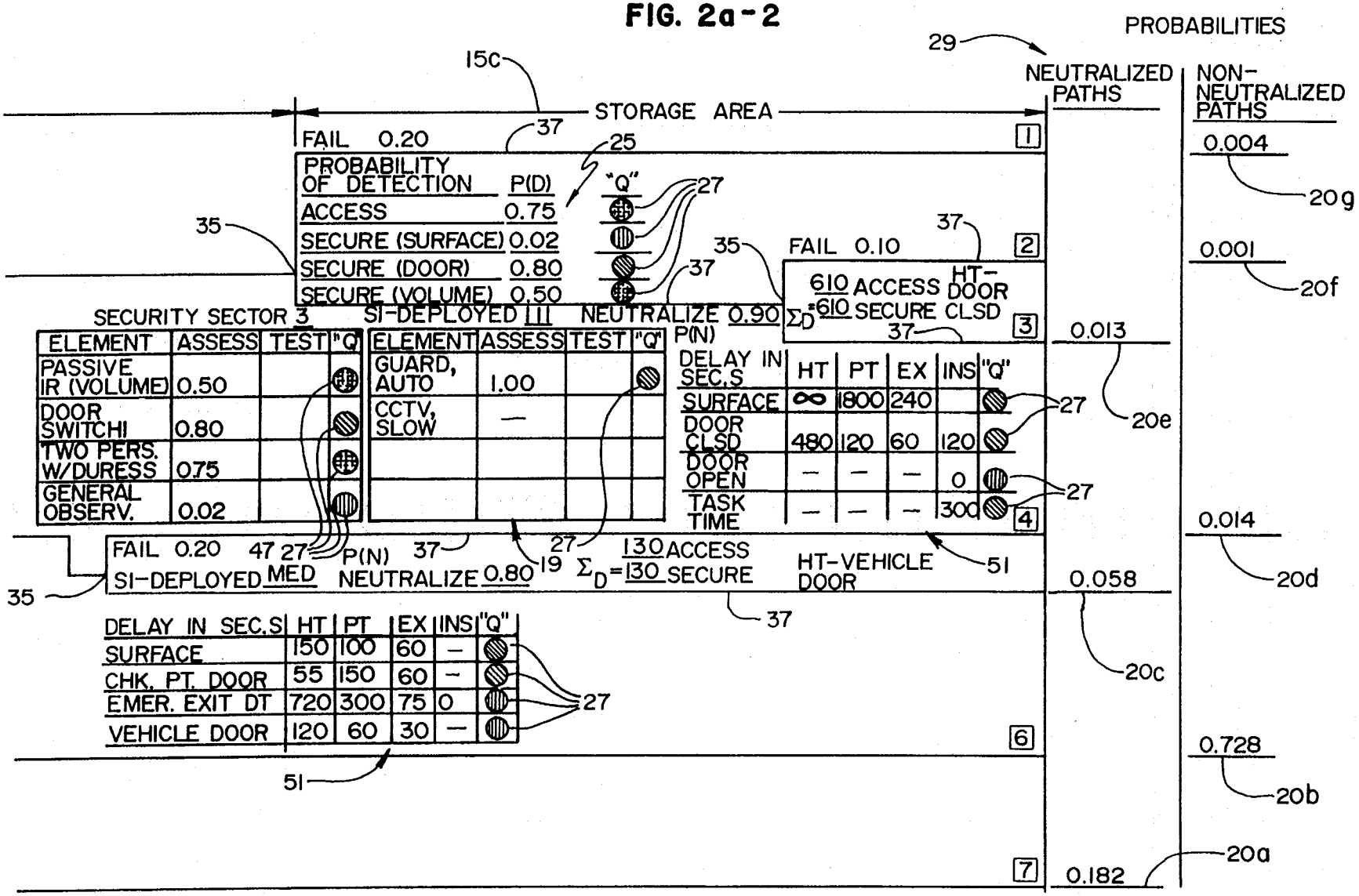
Figures 1, 2B:
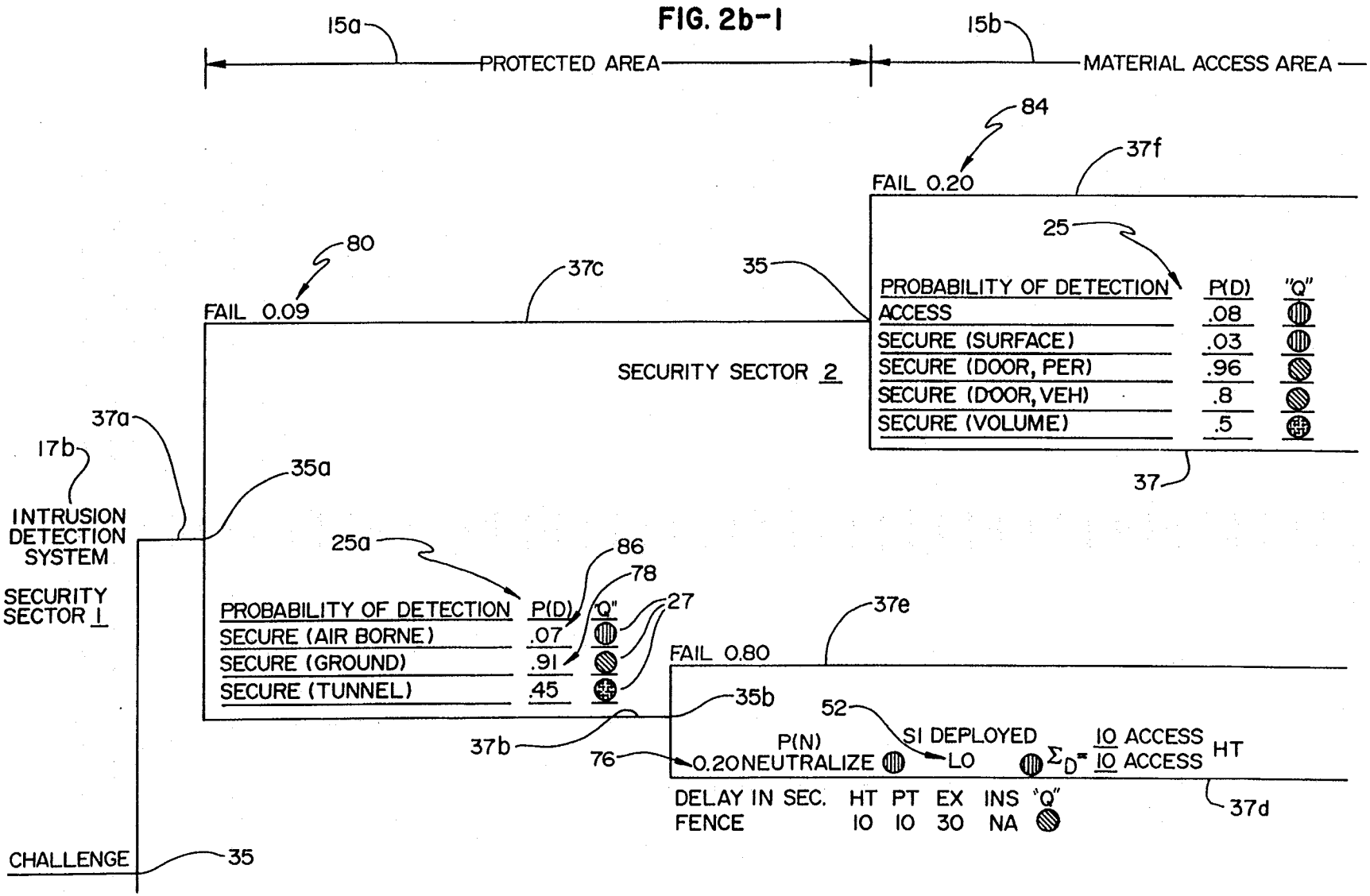
Figures 2, 2B:
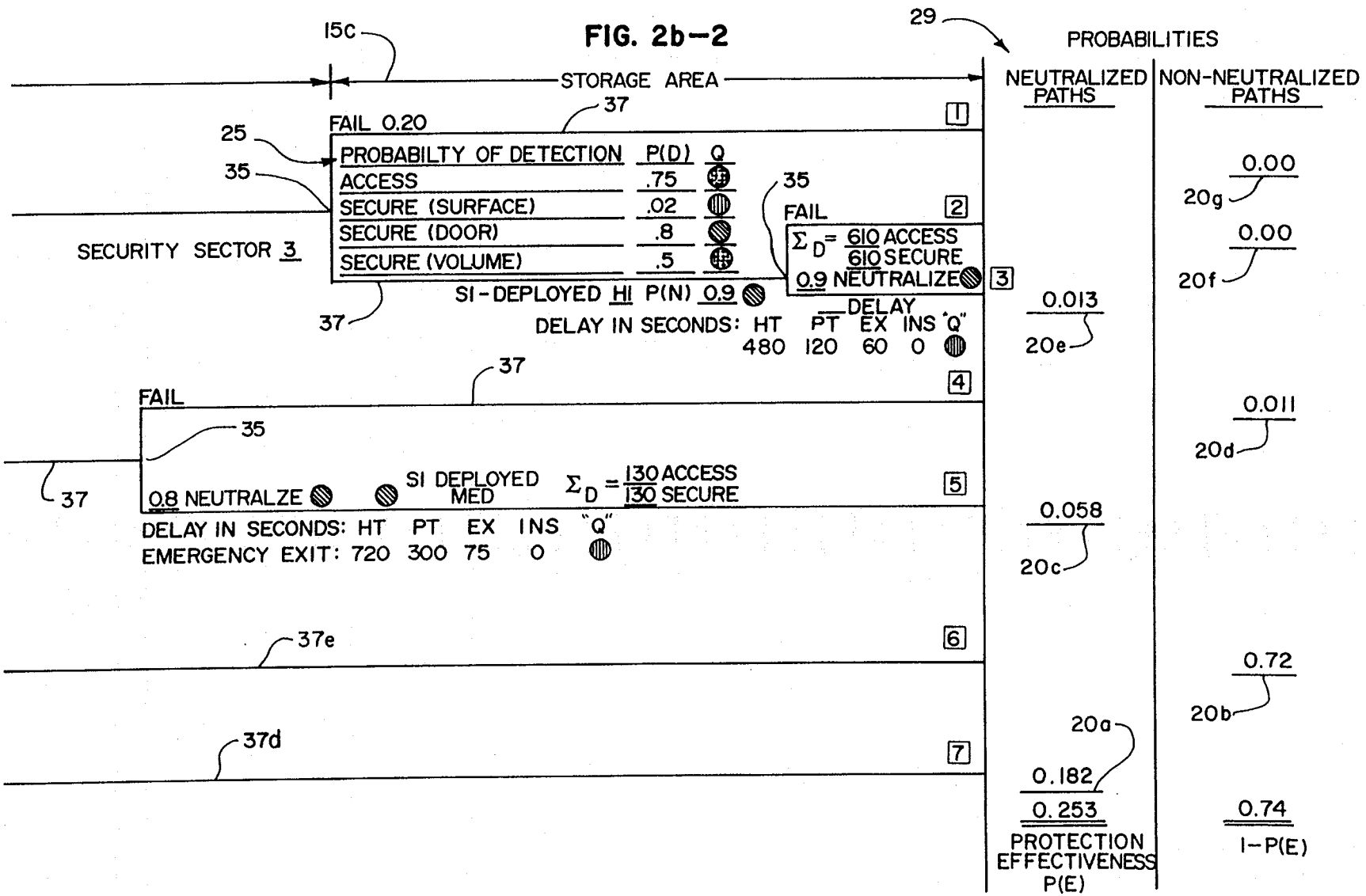
Figures 2, 2B, 3:
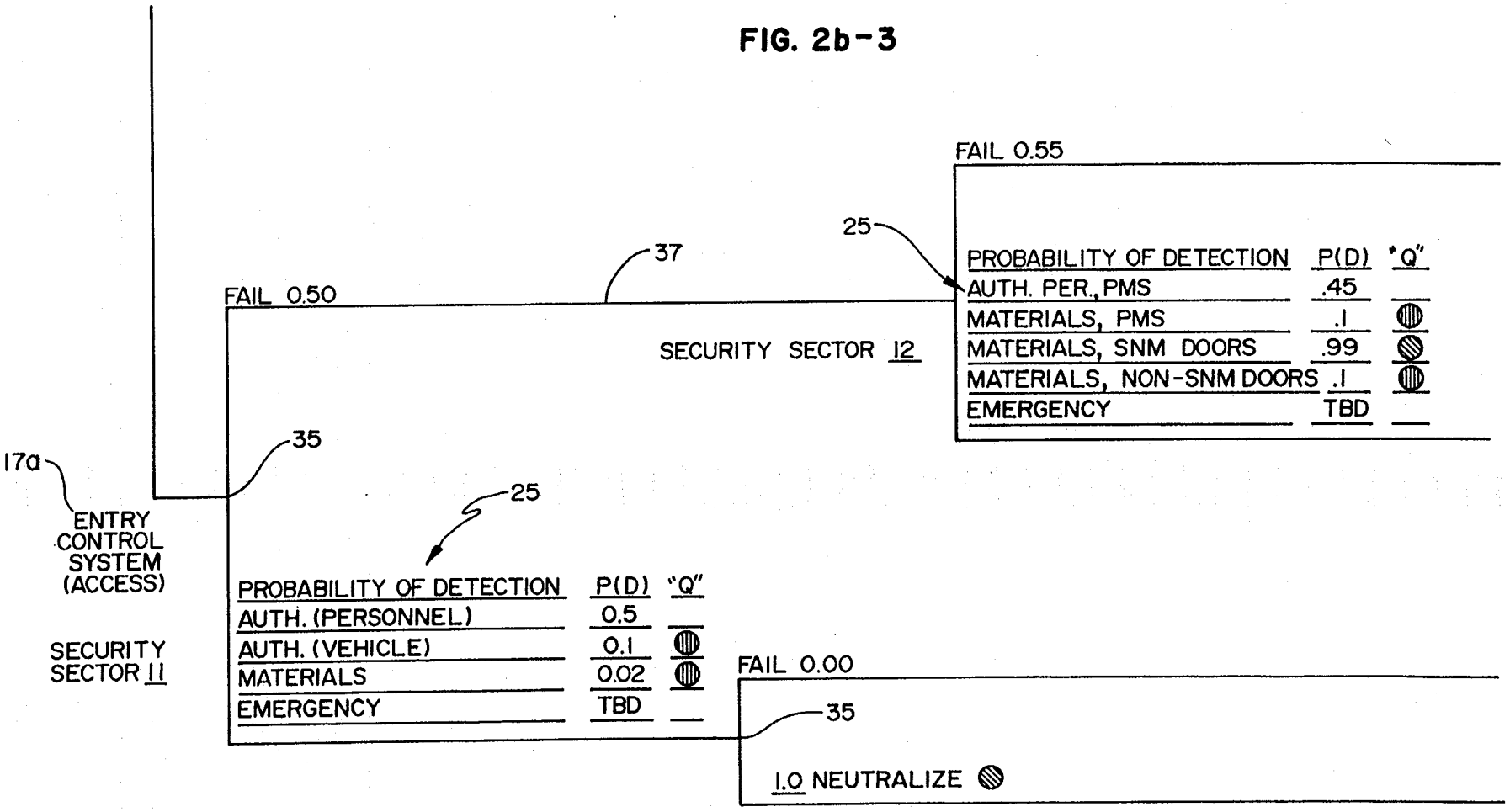
Figures 1, 2C:
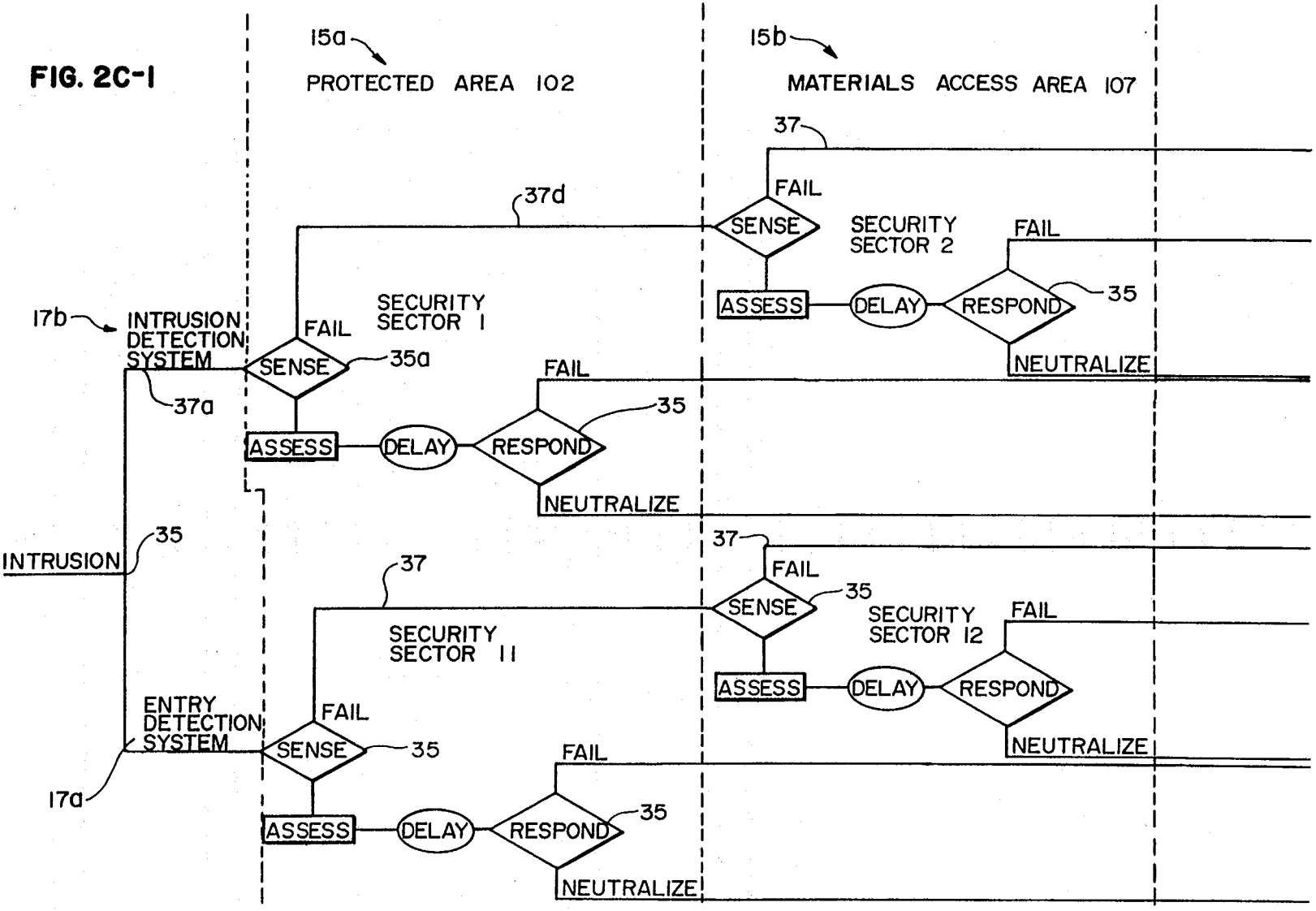
Figures 2, 2C:
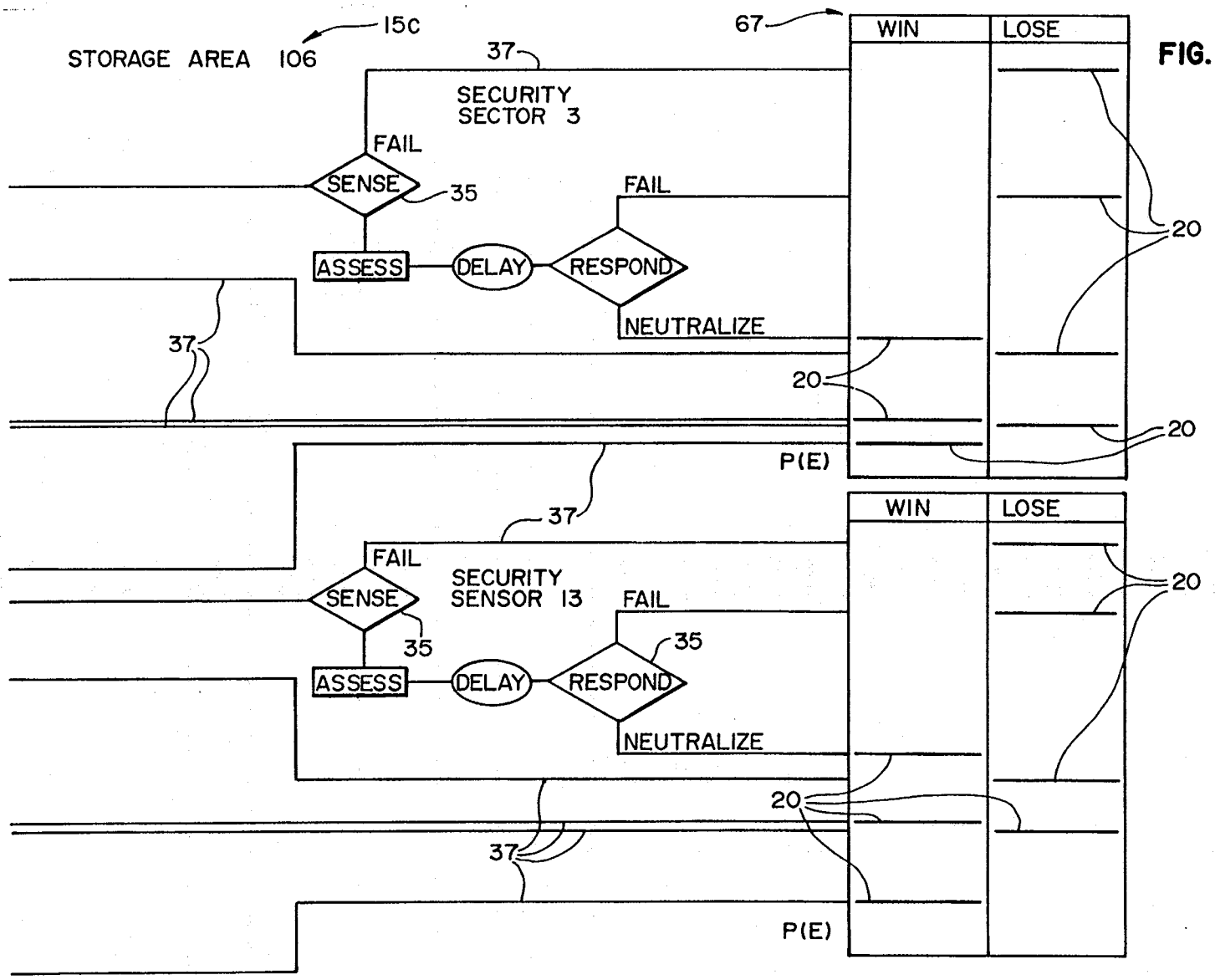

In still another alternative, the chart shown in (FIG. 2*c*-1 through 2*c*-2, herein after refered to) FIG. 2*c* depicts the protected installation 100 of FIGS. 1*a* and 1*b* using the color codes 63. The tables 19 have been replaced with summary blocks labeled "Sense," "Assess," "Delay," and "Response," and the outcome probability table 29 shown in FIG. 2*a* has been simplified into a "Win/Lose" table 67 (FIG. 2*c*).

The method of this invention could also be accomplished by using a computer spreadsheet or other computer program.

The system-wide evaluation of security elements disclosed by this invention affords many advantages over the typically disjointed approach of the field today. Interrelationships of the security elements, the security sectors, the security layers, or the security subsystems are logically, schematically, and functionally determined, thereby allowing for the weaknesses of a security system to be pinpointed by this method. The method can be further employed to design optimal security systems at any phase of planning or to evaluate the effect of proposed enhancements to a given security system. The proposed enhancement is tabulated in the appropriate security sector of the chart of FIG. 2*a*, 2*b*, or 2*c*, and the potential improvement is numerically quantified or categorized in terms of increases in the corresponding protection effectiveness value P(E). The proposed elements of a planned security system are similarly tabulated and evaluated to yield optimal values for the probabilities of detection P(D), the outcome probabilities 20, and the protection effectiveness values P(E). Other and further advantages are readily discernible to those skilled in the art.

Although the present invention has been described with reference to a preferred method and a particular working example illustrated in the accompanying drawing, various changes and modifications can be made to the steps of the method by those skilled in the art without departing from the spirit and the scope of the present invention.

The invention claimed is:

1. A method for equipping a protected facility, such as a building, manufacturing site, or storage depot, with a security system comprising the steps of:

a. creating physical zones within the protected facility;

b. providing security elements to be located in the physical zones of the protected facility;

c. associating a security rating with each of the security elements;

d. providing means for tabulating identifiers for the security elements and values for the security ratings according to the physical zones;

e. determining a value for the probability of security detection in each of the physical zones as a function of the security elements in each of the physical zones and the security ratings corresponding to the security elements in each of the physical zones;

f. determining outcome probability values for the physical zones as a function of the probability values of detection and intrusion paths into the protected facility, and locating the outcome probability values on the tabulating means, the outcome probability values corresponding to the effectiveness of the security elements in the physical zones, this determining step including the substeps of (1) configuring an event tree within the tabulating means, the event tree having branches corresponding to the intrusion paths; and (2) locating the probability values along the branches of the event tree; and g. installing the security elements associated with the outcome probability values of step f, to equip the protected facility with the security system that was produced by the outcome of the step f.

2. The method of claim 1, wherein the security ratings tabulated in step (f) include actual tested ratings of the elements.

3. The method of claim 1, wherein the tabulating means comprises at least one computer program.

4. The method of claim 1, wherein the tabulating means comprises at least one spreadsheet.

5. The method of claim 1, wherein the tabulating means comprises at least one human-readable chart.

6. The method of claim 1 comprising the step of determining overall protection effectiveness values from the outcome probability values.

7. A for evaluating security of a protected facility comprising:

a. a plurality of physical zones within the protected facility;

b. a plurality of security elements located in the physical zones, each of the security elements having corresponding security ratings;

c. means for determining probabilities of security detection in the physical zones as a function of the security elements in the physical zones and the corresponding security ratings;

d. intrusion paths crossing the physical zones of the protected facility; and e. means for determining outcome probabilities for a predetermined set of the intrusion paths as a function of the probabilities of detection of the security elements in the physical zones crossed by the intrusion paths;

whereby the outcome probabilities for the predetermined intrusion paths indicate effectiveness of the security system being evaluated.

8. The methods of claims 1 through 5 further including the steps of a. establishing a multi-color scheme representing different levels of acceptability on a selected scale; and b. associating color codes within the tabulating means with values tabulated therein to indicate the acceptability of the value adjacent to the color code.

9. The method of claim 1 comprising the step of optimizing the security system by installing the security elements associated with the outcome probability values having the highest values.

10. The method of claim 1 further comprising the steps of:

a. providing alternate security elements located in the physical zones;

b. recalculating the detection probability values and the outcome probability values for the alternate security elements;

c. comparing the recalculated outcome probability values to the calculated outcome probability value;

d. repeating steps (a), (b) and (c) zero or more times to tabulate further recalculated outcome probability values;

e. installing the security elements associated with the highest recalculated outcome probability values of any of the repetitions of the steps (a), (b) and (c) to equip the protected facility with an optimal security system.

11. The method of claim 10 comprising the step of applying fuzzy logic to the recalculated outcome probabilities to determine which of the security elements are adequate to optimize the security system.

12. The system of claim 7 comprising an event tree operatively associated with the determining means, the event tree having branches corresponding to the intrusion paths.

13. The system of claims 7, wherein the determining means comprise means for tabulating identifiers for the security elements and values for the security ratings.

14. The system of claim 13, wherein the tabulating means comprise a spreadsheet.

15. A system for optimizing security of a protected facility comprising:

a. a plurality of physical zones within the protected facility;

b. a plurality of security elements to be located in the physical zones;

c. means for determining probabilities of security detection in the physical zones as a function of the security elements in the physical zones and the corresponding security ratings;

d. intrusion paths crossing the physical zones of the protected facility;

e. means for determining outcome probabilities for a predetermined set of the intrusion paths as a function of the probabilities of detection of the security elements in the physical zones crossed by the intrusion paths; and f. alternative security elements to be located in the physical zones;

the determining means including a relative value scale and means for identifying the security elements having low probability values on the relative value scale, the determining means including means for redetermining probability value for the alternative security elements and means for comparing the recalculated probability values of the low probability values, whereby the elements having the highest probability values optimize the security system.

* * * * *